United States Patent [19]

Herman

[11] 4,425,932

[45] Jan. 17, 1984

[54] SIPHON LADLING APPARATUS

[76] Inventor: Trent S. Herman, 3273 Countryside Cir., Pontiac, Mich. 48057

[21] Appl. No.: 271,201

[22] Filed: Jun. 8, 1981

[51] Int. Cl.[3] ..... F04F 10/00

[52] U.S. Cl. ..... 137/143; 137/142; 164/254; 164/337; 222/416; 222/590; 222/595

[58] Field of Search ..... 137/142, 143, 144, 147; 164/63, 133, 254, 310, 337; 222/590, 595, 603, 416

[56] References Cited

U.S. PATENT DOCUMENTS

| | | | |
|---|---|---|---|
| 301,391 | 7/1884 | Reinecke | 137/142 X |
| 343,069 | 6/1886 | Rosewater | 137/147 X |
| 414,397 | 11/1889 | Goetz | 137/143 X |
| 1,944,733 | 1/1934 | Doerschuk et al. | 137/147 X |
| 3,552,478 | 1/1971 | Lauener | 137/142 X |
| 3,670,799 | 6/1972 | Vogel et al. | 137/142 X |
| 3,815,623 | 6/1974 | Farmer | 137/144 X |
| 3,921,859 | 11/1975 | Colombani | 164/254 X |
| 4,143,674 | 3/1979 | Portalier | 137/143 X |
| 4,179,045 | 12/1979 | Colombani | 164/63 X |

FOREIGN PATENT DOCUMENTS

| | | | |
|---|---|---|---|
| 2094603 | 2/1972 | France | 222/416 |
| 2293275 | 7/1976 | France | 222/595 |
| 55-60800 | 5/1980 | Japan | 137/147 |
| 56998 | 3/1969 | Poland | 222/416 |
| 296619 | 4/1971 | U.S.S.R. | 222/416 |

*Primary Examiner*—Gerald A. Michalsky
*Attorney, Agent, or Firm*—Gerald R. Hershberger

[57] ABSTRACT

A device for transfer of critical liquids, such as molten metals, has a body member including a short leg inlet liquid conveying passage submergeable in a large storage vessel containing the critical liquid. An intermediate high level liquid conveying passage is disposed over the vessel and connected in fluid transferring relationship to the inlet portion at one end, and at its other end to a long down leg passage which is connected to a smaller liquid storing chamber positioned substantially lower than the liquid level in the storage vessel. A pouring outlet is connected to the lower chamber to conduct liquid out of the lower chamber. The flow of metal is controlled by a vacuum source selectively connectable to the high level passage which causes a siphon action through the device. The lower chamber is adapted in cooperation with its storage vessel, to maintain a vacuum in the system during start up and the transfer of liquid from the storage vessel to the outlet. An intermediate smaller upper metering chamber may be included in the device between the large storage chamber and the short siphon leg for accurate metering of smaller quantities of liquid.

10 Claims, 7 Drawing Figures

Fig. 4
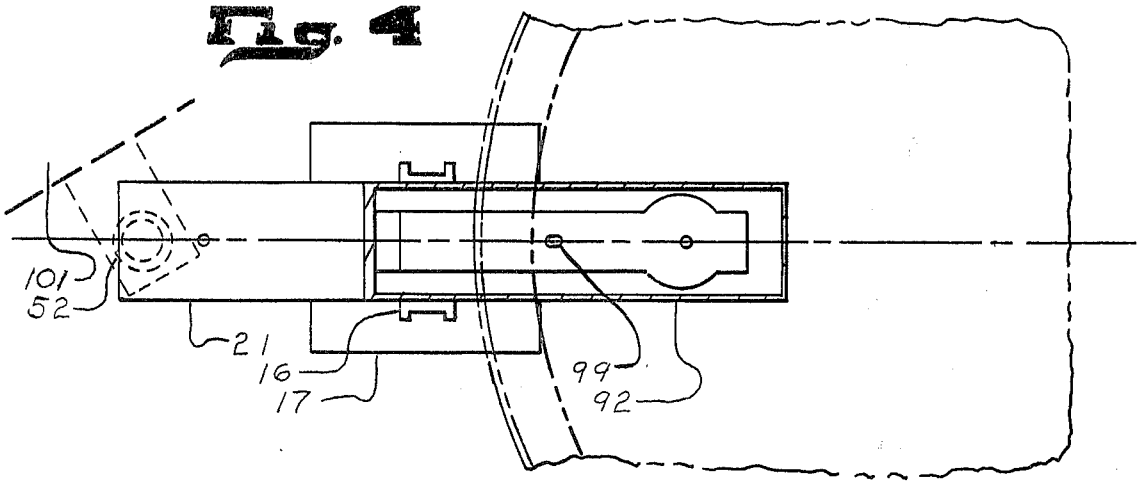
Fig. 5
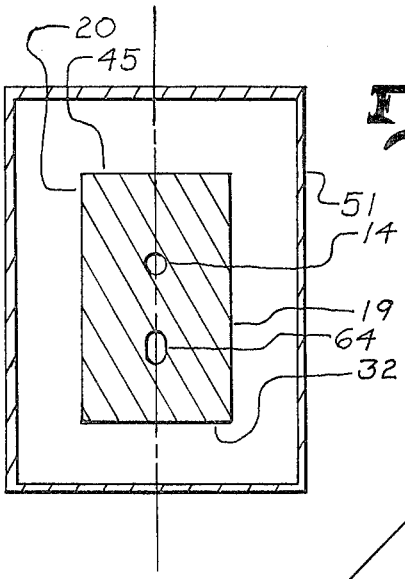
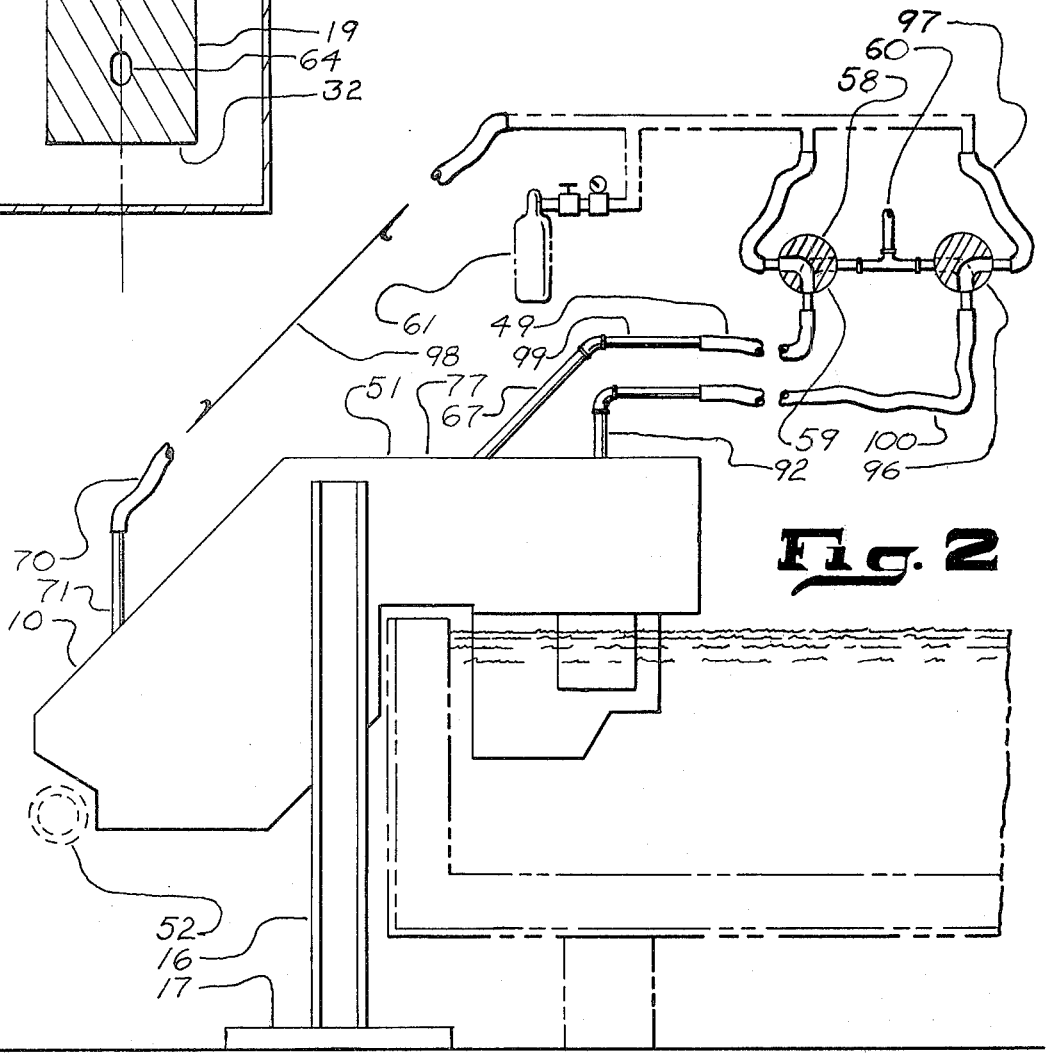
Fig. 2

SIPHON LADLING APPARATUS

BACKGROUND OF THE INVENTION

This invention relates to means for handling the transfer of and metering of critical liquids, such as molten metals, which are difficult to handle and deliver because of their corrosive, abrasive or other deleterious characteristics which adversely effect the operation of the conventional flow regulating elements employed to regulate the liquid flow.

It is well known to persons skilled in the art of handling critical liquids such as melting and handling of molten metals as well as those involved with handling other high temperature or chemically active liquids that such critical liquids cannot be stored in a container where they come in contact with mechanical type flow regulators such as those contained in a valved gravity outlet. Under such circumstances, the liquids either dissolve the regulator or valve or cause build-up on them until such regulators malfunction or leak with a resulting loss of function, hazard to personnel, loss of the fluid, or damage to surrounding equipment. The present art solution is to lift and tip the container to pour liquid out of it, dip the liquid, pump the liquid, or pour the liquid, using an electromagnetic elevator. Each of these methods have disadvantages which may or may not apply to any particular fluid. Pouring can be very slow if the container is large such as a melting furnace in a foundry. Both pouring and dipping must break through any dross or other covering, either natural or added, and both methods can result in unwanted splashing of the liquid. Pumping is usually costly since the mechanical parts suffer from the same problems as valves. Pneumatic pumping with both pressure and vacuum has been achieved by sealing the complete container, but such systems are susceptible to leaks in the seals of the refill parts.

SUMMARY OF THE INVENTION

The present invention is directed to a solution of the above mentioned deficiences of the prior art, and in so doing provides for the long term continous transfer and delivery of critical liquids, particularly molten metal or liquid slag or short term metering of precise amounts thereof from a storage vessel on demand. The ability of the device to meter precise amounts on demand allows for the integration of the liquids primary holding container with an automatic machine such as a die casting machine or a molding line without serious deterioration of total system reliability.

In accordance with the present invention, an arrangement is provided for the delivery of predetermined amounts of critical liquid from a primary storage vessel wherein delivery is controlled therefrom by a siphon-like apparatus. The arrangement comprises a storage vessel or container for containing a supply of critical liquid. A short siphon passage leg is inserted in the liquid and extended upwardly to a high point or high level passage above the primary container. A long siphon passage leg is connected to the high level passage and extended outside the vessel downwardly below the level of liquid in the storage vessel where it interconnects with a chambered fluid air-trap located substantially below the height of the primary vessel. A liquid outlet is provided in the lower chamber for transferring liquid from the lower chamber to the liquid receiving means. Vacuum or negative pressure means is employed to apply a low grade vacuum or negative pressure to the siphon-like apparatus adjacent the high level passage to start the siphon flow of liquid from the storage container to the receiving means.

According to the invention a higher intermediate upper storage chamber of less capacity than the initial melting furnace may be provided which is connected to a short siphon leg at one end and connected to the liquid in the melting furnace at its other end for transferring liquid in smaller measured amounts from the upper chamber to the lower chamber.

Further to the invention, a dual vacuum control means may be employed, the first vacuum control element thereof being connected to said higher upper chamber and the second vacuum control element thereof being connected to the high level passage of the siphon, the first vacuum element is adaptable to pre-fill the higher chamber with liquid, and the second vacuum element is adaptable to pre-fill the inner air-trap chamber with liquid and start and stop the siphon liquid flow.

Further in accordance with the invention, automatic switching means may be employed to control the dual vacuum elements in filling the chamber and regulating the flow of liquid.

Also in accordance with the invention, the siphon long lower leg may be provided with an elongated enlarged portion to facilitate release of air and gas bubbles from the device while the liquid is flowing through the passages.

Further, in accordance with the invention, a means is provided to selectively start and interrupt the siphon flow of liquid which does not employ mechanical or electrical moving part which contact the liquid.

Further to the invention, means is provided for sealing the liquid flow outlet passage of the device during the priming thereof to allow vacuum to fill the chamber or chambers in the device with liquid prior to operation thereof.

According to the invention an apparatus for transferring liquids is provided which requires substantially light vacuum or power to effect the flow of liquid.

Another object of the invention is the provision for a fail safe arrangement whereby the device will automatically cease to operate and require re-priming if the siphon flow interrupt means fails to operate.

A further object of the invention is to provide for automatic operation of the "pour cycle" by activation from the die casting machine or liquid receiving means.

A principal object of the invention is to provide a liquid controlled air-trap means for maintaining a vacuum in the liquid transfer passages of the siphon apparatus during and after transfer of the critical liquid.

For a better understanding of the present invention together with other purposes and objects thereof, reference is made to the following detailed description and accompanying drawings while the scope of the invention is pointed out in the appended claims.

BRIEF DESCRIPTION OF THE DRAWINGS

In the Drawings:

FIG. 2 is a side elevational view showing the control means for the device of FIG. 1, taken on the lines 2—2 of FIG. 3.

FIG. 4 is a plan view of the embodiment of FIG. 1, taken on line 4—4 of FIG. 1.

FIG. 5 is a transverse sectional view of the embodiment of FIG. 1, taken on line 5—5 of FIG. 1.

DETAILED DESCRIPTION OF THE INVENTION

Figure 7:
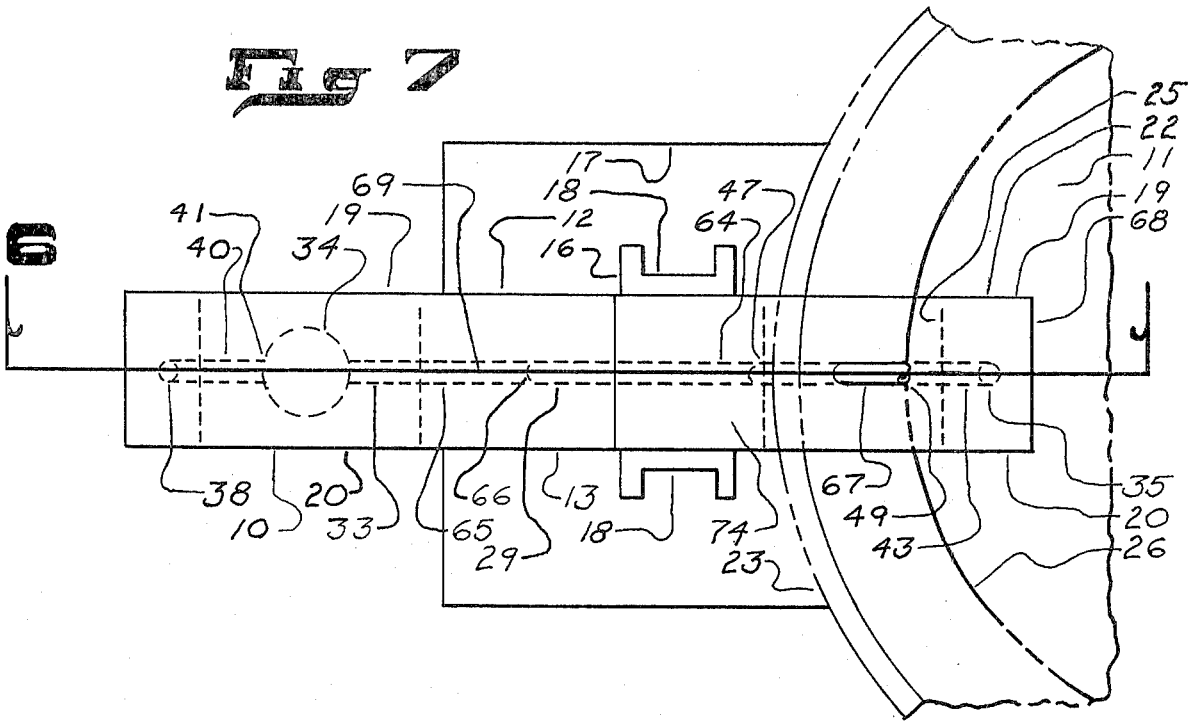
FIG. 7 is a plan view, partly sectional, of the device of FIG. 6, taken on line 7—7 of FIG. 6.
Figure 6:
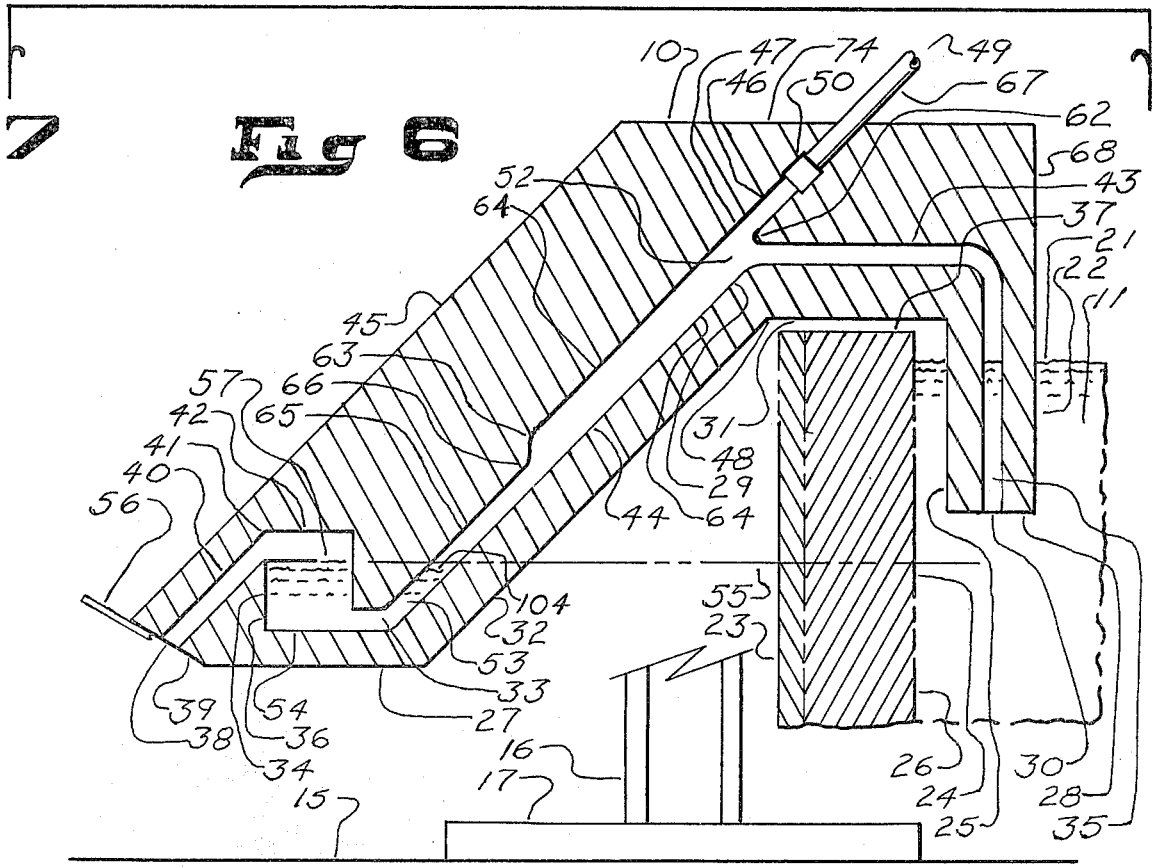
FIG. 6 is a side elevational view, partly in section, of a device similar to the device of FIG. 1 without the intermediate storage chamber, taken on line 6—6 of FIG. 7.

Referring initially to FIGS. 6 and 7, a primary embodiment of the invention includes a core, block or body 10 of generally rectangular plan view outline and generally shoe-like elevational outline. The body 10 may be constructed of any material suitable for containing the liquid or melt 11 at a suitable consistancy for metering, such as castable alumina-silica refractory material for ladling molten aluminum.

The core may be cast in one-piece, molded in halves 12 and 13 and cemented together with a refractory mortar or alternatively manufactured from suitably adapted pipes and containers. The conventional heating elements 14 (shown in FIG. 1) are preferrably electrical resistance heaters that maintain the temperature of the body at about the same temperature as such melt 11. The body is provided exteriorly with a cover 51, (shown in FIG. 1) and suitable insulation (not shown) is installed between the body exterior and the cover. The body is supported above the floor 15 in the position shown in FIG. 2 and FIG. 6 by stand means 16 having a base 17 resting on the floor and upright vertical channels 18 mounted on said base fixedly fastened to the sides 19 and 20 of the body.

The stand means supports the body adjacent and over the open supply reservoir 23 with the elevated rearward heel-like inlet portion 22 of the body partially submerged in the melt adjacent the inside wall 24 of the reservoir 23. The reservoir rim top 37 is fixedly disposed adjacent inlet portion inside vertical wall 25, above inlet portion bottom wall 28 and adjacent the inner horizontal wall 31 of the body. The wall 31 intersects the inner vertical wall 25. The inner horizontal wall portion 31 extends forwardly to intersection 48 where wall 32 is directed downwardly at an angle of approximately 45 degrees from horizontal to a lower forward horizontal wall portion 27 of the toe disposed substantially below the level of the melt 21. Face 39 is obliquely turned upwardly and forwardly from said horizontal wall portion 27 to intersect an upper rearwardly sloped wall 45 which generally parallels downward wall 32 to a horizontal upper wall 74, extending rearwardly to outer vertical inlet portion wall 68. The wall 68 extends downwardly vertically to intersect the bottom inlet wall 28, and inside vertical wall 25 also extends vertically downward to intersect bottom wall 28, completing the general outline of the body in the elevational view.

In the plan view, the device is seen to be of generally rectangular outline with the bulbed holding chamber 34 disposed in the forward end thereof adjacent face 39, and the inlet portion 22, located adjacent the rearward end thereof.

The fluid passage means 29 associated with said body is located generally centrally along the joint line 69 thereof and includes an elevated intermediate siphon conduit normal sized portion 43 disposed above said inner horizontal wall 31 and above a horizontal plane defining the pre-established top surface 21 of the melt 11 in the supply reservoir and connected by conduit means including a comparatively short upstream siphon conduit leg 35 disposed vertically in the inlet portion 22 to the intake port 30 located in the horizontal bottom face 28 of the inlet portion 22, which intake port is submerged in the melt in the supply reservoir 23. The generally horizontal elevated leg or branch portion 43 is further connected in conduit relationship to downwardly depending comparatively longer downstream siphon leg 44 which parallels wall 45 and whose lower end 53 communicates with a bottom inlet 33 in the bulbed holding chamber 34. The long leg passage 44 is increased substantially cross-section-wise from its normal size at the forward intersection 52 of said long leg portion with the elevated passage portion 43 and extended a substantial distance forwardly down the long leg to a corner 63 to form an enlarged air and/or gas bubble release passage section or portion 64. The larger section is necked down or blended from the corner 63 to the normal sized passage portion 65 at corner 66.

The bulbed holding chamber 34 is disposed adjacent the the lower forward wall portion 27 and oblique face 39 of the body and has interior walls defining an interior space 36 which is effective to maintain a substantial volume or quantity of molten metal therein.

The inlet 33 is located adjacent the bottommost spaced wall 54 which is disposed adjacent lower body wall 27. Conduit means including a discharge port 38, located in oblique face 39 is connected by passage 40 to chamber outlet 41, located in the uppermost wall portion 42 of said chamber 34, which wall 42 is located substantially below corner 66. It is deemed important that the uppermost wall 42 of the bulbed chamber and the chamber bottom 33 be located a predetermined distance below the level 21 of the melt 11, that is intended to be drawn from reservoir 23 to facilitate the delivering by siphon action of melt from the reservoir out the discharge port. The intake port 30 is disposed a substantial distance below the initial or starting level 21 of the melt 11, and the volume of melt that can be siphoned from the reservoir is determined by the head or difference between the initial level of the melt 21 and a secondary level 55 defined by the melt disposed above a horizontal plane through the bulbed chamber outlet 41, or the melt disposed above intake 30 when intake 30 is disposed above secondary level 55. The reservoir 23 is of well known construction and the invention may be used in connection with any conventional type of furnace or reservoir. The capacity of the reservoir is understood to be many times greater than the bulbed chamber 34 capacity. The extension of the body inlet portion 22, below the melt also prevents dross or other undesirable substances entering the fluid passages.

Although the device will now function as a siphon to ladle melt from the reservoir 21 out the discharge port 38 when a vacuum is applied to the discharge port, until a siphoning effect is obtained, the flow would be continuous until the entire head of melt was dispensed, and not suitable for molding practice. Therefore, means for selectively interrupting the flow of melt on demand is provided, which means utilizes the principle of the siphon and does not employ mechanical parts, such as valves, or the like, in the body of the device. The means for selectively interrupting and starting the flow of melt from the reservoir is accomplished by disposing air aperture means 67 above the passage 43 which includes a fluid passage 46 communicating with the elevated branch 43 at one end 47 and at the other outlet end 49 thereof with a means for introducing atmospheric or negative pressure into the passage means 29. The fluid passage 46 may comprise a pipe means 50 inserted and sealed into body 10 so that the pipe may be more conveniently connected to the air inert gas or vacuum source. (Shown on FIG. 2).

The device is now ready to be activated, and the discharge port 38 is located in liquid dispensing relationship over the sprue (not shown) of a mold or (as is shown in FIG. 2) over the shot sleeve 52A of a conventional die casting machine (not shown) and the molten metal in the reservoir will have filled with melt to a level equal to the level 21 in the reservoir.

Assuming at this point, that atmospheric pressure is introduced into pipe means 50, the liquid will rise in the short leg passage 35 to the same height as the level 21 of the melt, and when the negative pressure or vacuum is applied to the outlet end 49 the melt in the leg will stay at the same level, because air will enter the chamber and passage means through the discharge port and negative pressure cannot be established in the system. Therefore, before the device can deliver melt as intended, it is necessary to prime the device by filling the chamber 34 by plugging or stopping the discharge port 38 of the body, preferrably with a fibre or thin steel plate 56, and then apply vacuum to the pipe outlet 49 of the air aperture means. When negative pressure is applied thereto, liquid will rise in the vertical stem or short leg passage 35 upwardly to the high level or elevated intermediate conduit or passage 43 pass therethrough and down the long leg passage into the chamber 34. When chamber 34 overflows, the liquid flows out the discharge port 38 forcing the fibre or metal plate 56 away from the discharge port. The pipe outlet end 49 is then disconnected from the source of negative pressure and atmospheric pressure introduced which interrupts the siphon action causing the liquid to stop flowing. At that point, some of the liquid flows down passage 44 into the chamber 34, the excess flowing out the discharge port and some of the liquid remains in the long leg passage at the same level 57 as the melt in the chamber 34, sealing the discharge port to atmosphere.

The apparatus is now primed and ready for intermittent operation. From here on it is not necessary to plug the discharge end of the body in order to start the siphon flow of liquid from the furnace reservoir to the shot sleeve, when negative pressure or vacuum is applied to pipe outlet 49, liquid rises by atmospheric pressure up the short leg into the elevated passage and simultaneously rises up the long leg which drains some of the liquid out of the chamber 34 further upwardly into the long leg 44, however, the chamber configuration is large enough so that a substantial quantity of liquid remains in the long leg passage and chamber to maintain a seal against air flow through the chamber and long leg passage. With negative pressure maintained pipe aperture 49 liquid will begin to flow from siphon effect over the elevated portion 43 and down the long leg passage 44 and into the chamber 34 and out the discharge port 38 for as long as the negative pressure is held. The melt flow time may be determined by manual application means or predetermined by timing means (not shown) connected to a primary valve means 58 as shown in FIG. 2. The valve means includes a valve 59 which is connected manually or automatically alternatively to a vacuum source 60, to atmospheric pressure, or to an inert gas source 61, maintained substantially at atmospheric pressure.

The degree of vacuum or negative pressure required to operate the device is very light since the flow is accomplished by the siphon effect and the advantageous arrangement of the chamber and passages in relation to the head of melt as previously described.

The larger long leg air release passage portion 64, disclosed in both versions, allows any air or gas bubbles which may have been carried into the passages with the melt to escape simultaneously upwardly beside the downwardly flowing melt and out the air aperture means 67, and also facilitate flow of melt freely down the long leg passage.

FIGS. 1,2,3,4 and 5 illustrate another version of the system or device which has advantages which may be used under certain conditions requiring metering of precise amounts on demand.

The structure for this version is much the same as described supra forwardly of the short upstream siphon leg 35 except that a vent aperture means 70 having a vertically disposed vent pipe 71 communicating with chamber upper outlet 72 in the lower chamber upper horizontal wall 42 is provided in this version. The melt inlet portion 73 comprises a rearward continuation of surface wall 74 to rear vertical inlet portion wall 75, which wall 75 extends downwardly into the melt to a bottom horizontal bottom wall 76. Bottom wall 76 extends forwardly to intersect vertical inner wall 25, completing the outline of the core body 77. Additional conduit means 78 is contained in the inlet portion 73, including an inlet passage 79 disposed adjacent rear vertical wall 75 which has an inlet port 80 submerged in the melt. The passage 79 extends vertically to communicate with a forwardly directed bend portion 81. The short bend portion 81 communicates with an inlet 82 above the melt level 21 in the rearward wall 83 of the upper reservoir intermediate chamber 84. The upper chamber 84 is disposed adjacent the passage 79 and has interior walls defining an interior reservoir space 85 which is effective to maintain a quantity of melt therein that will fill casting molds of predetermined size. The intermediate chamber space 85 is much larger than that for lower chamber 34 and much smaller than the reservoir 23. The upper chamber upper horizontal wall 86 is disposed a short distance above the level 21 of melt 11, and the bottom horizontal wall 87 is disposed substantially below the level 21 of melt 11. A lower conduit passage portion 89 communicates with an outlet port 88 in the bottom wall 87 and is reversely bent downwardly and then upwardly to communicate with vertical siphon leg portion 90. The vertical siphon leg portion 90 corresponds with siphon leg 35 of the prior disclosure herein. The forward vertical upper chamber wall 91 is disposed adjacent the siphon leg portion 90. In addition to the air aperture means 67 a second air aperture means 93 is provided in the system having a vertical fluid passage 92 communicating with the upper wall 86 of the upper chamber at its lower end and at its other end 94 with the valve means 96 as shown in FIG. 2 for introducing atmospheric 61 or negative pressure 60 into the upper chamber 84. The melt flow time periods can be accomplished by valve means 96 operating in synchronization with first valve means 58. Valve means 96 is likewise connected manually or automatically to vacuum source 60 or to atmosphere or to inert gas source 61 at very near atmospheric pressure by line 97. Line 98 connects gas source 61 to pipe 71. The valve means 96 and 58 are of prior art construction and preferrably electrically operated, having valves that will direct atmospheric or negative pressure to the device through conduit lines 99 and 100.

Figure 3:
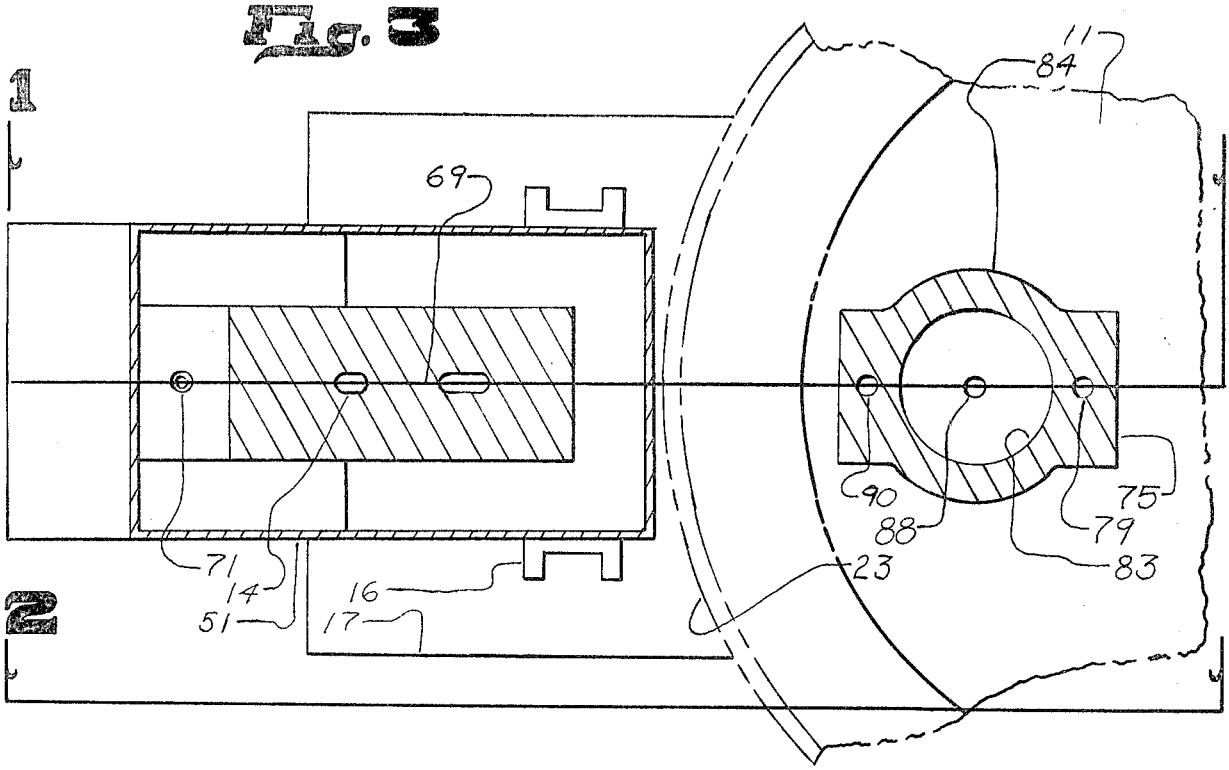
FIG. 3 is a sectional plan view taken on line 3—3 of FIG. 1.
Figure 1:
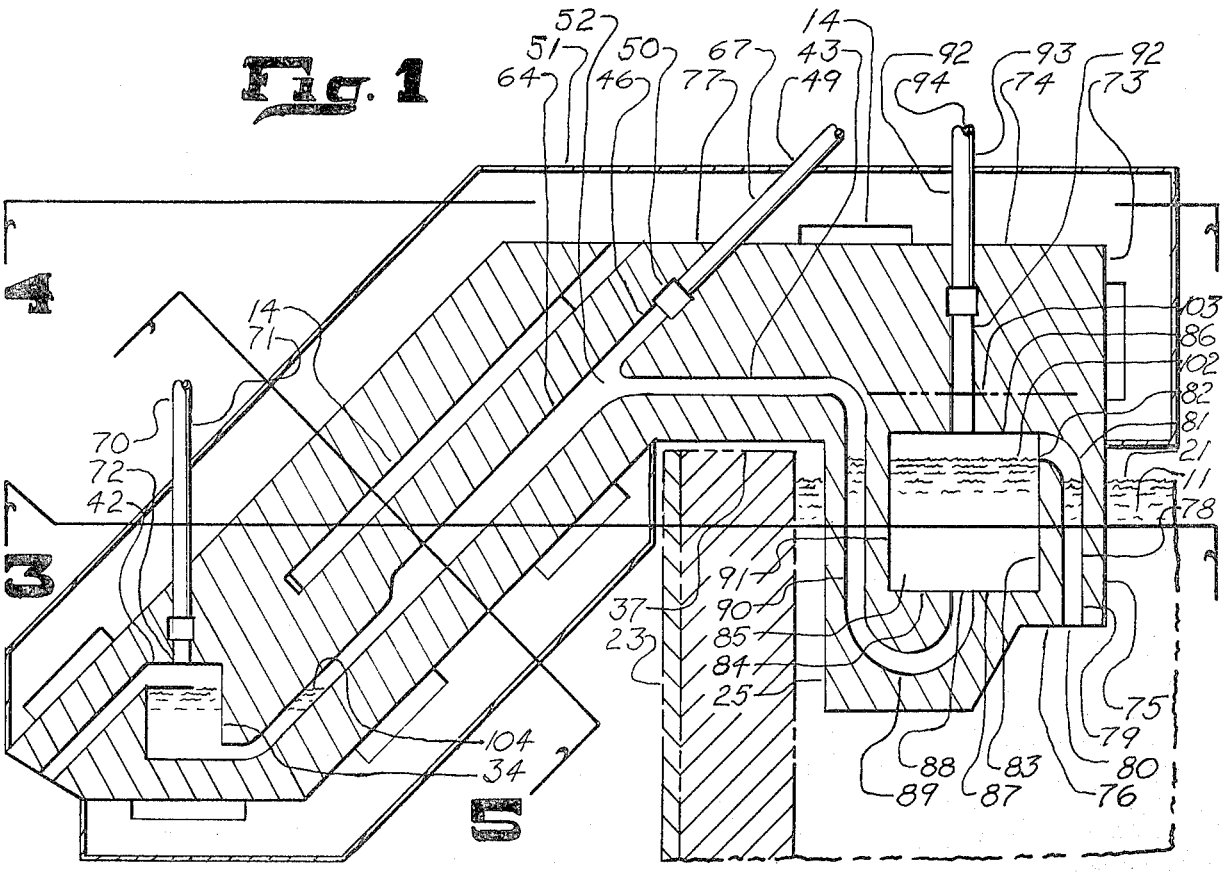
FIG. 1 is a side elevational view, partly in section, of the device having an intermediate storage chamber, taken on the line 1—1 of FIG. 3.

When the latter version of the device is first installed in the position shown in FIG. 1 relative to the molten metal reservoir 23 and shot sleeve 52A of a die casting machine 101, molten metal or melt will rise into passage 79 to the level 21 of the melt 11, but will not flow into upper chamber or reservoir 84. The chambers and passages in the device will be empty. Therefore this version must likewise be primed, or set, and the first step in the cycle is to temporarily block entry of atmospheric pressure from entering outlet or discharge port 38, valve 58 and vent 71. That can be accomplished with plugs, plates or valves, as previously disclosed herein for version 1. Valve 96 is then shifted to apply vacuum or negative pressure to passage 92 and chamber 84. Atmospheric pressure on melt 11 will push the melt up passage 79 and it will spill into chamber 84. As chamber 84 fills, the melt will rise in passage 92 to a predetermined level 103 by the negative pressure of the vacuum. Valve means 96 is then moved to disconnect the vacuum from line 100 and thereby re-introduce atmospheric pressure 61 into passage 92. Melt will then drain from the chamber 84 back into the reservoir 23 through passage 79 until the melt in chamber 84 is at the level 102 of inlet 82. The melt will also have filled passage 89 and 90 up to the same level 102 as in chamber 84.

The next step in the "priming" sequence is to shift valve 58 to apply vacuum through conduit line 99 to lower chamber 34. The air flow into discharge port is stopped, as indicated previously, by a plug or plate over the discharge port 38 and atmospheric pressure will hold the plate in place and negative pressure will then be established throughout passages 89, 90, 43, 47, 64, 65, 33, 40 and chamber 34. Atmospheric pressure entering through valve 96, line 100 and passage 92 will push melt from chamber 84 through passage 89 and up 90 across passage 43 to passage 64. The molten metal will run down passage 64, fill chamber 34 and then flow down passage 40 and out discharge port 38. The weight of the melt will push away the block or metal plate blocking the discharge port and a continuous flow of melt will be established from chamber 84 and out the discharge port due to siphon-like action. The flow is stopped by shifting valve 58 to allow atmospheric pressure into passage 46, which stops the siphon-like action. As a fail safe feature, if atmospheric pressure is not introduced into passage 46 before chamber 84 empties, the priming procedure must be repeated from the beginning. When atmospheric pressure is introduced into passage 46 to the siphon action, the melt left in passage 64 and 65, will flow of its own weight into chamber 34 and out port 38 until the excess metal in chamber 34 runs out, leaving sufficient metal in chamber 34 to form an air lock in passage 65 and 64. The blockage to vent 71 is then removed so atmospheric pressure (or inert gas at near atmospheric pressure) will be applied to chamber 34.

Melt is now at atmospheric pressure in chamber 84 and passage 89 and 90 below maximum level 102, at atmosphere in chamber 34 and passage 65 above level 104, and at atmospheric pressure in passage 89 and 90. All the other chambers and passages within the device or body 77 are at atmospheric pressure filled with air or inert gas such as nitrogen or a gas flux as introduced through the valves and the vent 71, when chamber 34 is full.

To complete the priming operation, the valve 96 is shifted to introduce vacuum to passages 92 and chamber 84 for a length of time adequate to fill chamber 84 with melt from reservoir 23 through passage 79. While the vacuum is applied, the level in passage 89 and 90 will fall below level 102, and the melt will eventually achieve predetermined level 103 in passage 92. At the end of the timed period, atmospheric pressure is reintroduced to chamber 84 by shifting valve 96 and molten metal will drain out of chamber 84 through passage 79 until the molten metal in chamber 84 and passage 90 is at level 102. The device is now primed and can be recycled on demand.

THe "pour" cycle can be initiated by an electrical signal from the die casting machine 101 or from a mold indexing system (not shown). Such signal indicates that the die casting machine or mold is ready to receive melt. Such signal shifts valve 58 to apply vacuum to passages 89, 90, 43, 46, 64 and 65, and simultaneously starts a timer (not shown). Atmospheric pressure entering vent 71 and passage 40 pushes the molten metal in chamber 34 down from level 104 in the chamber and up from level 104 in passage 65 and 64 and the resulting head pressure therein will equal the negative pressure. The melt in chamber 34 will not allow air to enter passage 65 through port 38. Atmospheric pressure is entering chamber 84 through passage 92, valve 96 and will push the melt up passage 90, so it will run across the high point or elevated portion 43 and down passage 64, 65, and 33, into chamber 34. As the melt accumulates in chamber 34, the level of melt in chamber 34 will rise and overflow out port 38 into the die cast machine's shot sleeve 52A or into a mold (not shown).

The pouring will continue due to the siphon action until the timer that was started when valve 58 was shifted times out and causes valve to shut off vacuum thereto and allow atmospheric pressure to enter passage 46. The pour stops with the melt in chamber 34 and passage 65 at gravity level 104, and the melt in chamber 84 and passage 90 at a level below inlet 82. The melt in passage 79 will be at level 21 of melt 11. The device shall then automatically sequence through the priming cycle or set cycle as described above to refill chamber 84 and await the next signal to "pour".

The modified device is "fail safe" in the sense that only the volume of melt in chamber 84 can be dispensed in the event of a malfunction, which would otherwise cause continuous flow through the device.

It will thus be seen that the objects hereinbefore set forth may be readily and efficiently obtained, and since certain changes may be made in the above device and different embodiments of the invention could be made without departing from the scope thereof, it is intended that all matter contained in the above description or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. In a siphon-like device for intermittent delivery of predetermined amounts of critical liquids on demand from a primary supply reservoir, said device comprising an enclosed hollow body having internal passage means arranged generally in the outline of a siphon including walls defining an upstream passage leg having an inlet portion adapted to be submerged in the reservoir liquid below the surface thereof, walls defining a downstream passage leg disposed outside of the reservoir having an outlet portion terminating substantially below the top horizontal surface of the liquid in the reservoir and walls defining a fluid delivery outlet portion having an outlet and an inlet disposed substantially below the surface of the reservoir liquid forwardly of said downstream passage leg, said legs being joined together in fluid passage relationship at their upper extremeties to form an intermediate elevation passage portion over the surface of the liquid; the improvement which comprises:

air aperture means having upwardly depending walls defining a passage connected in conduit relationship to said passage means adjacent said intermediate level passage portion, and critical liquid air-lock means having walls defining a substantially large bulbed trap-like holding chamber having its bottom end connected in fluid relationship to the downstream lower outlet portion and its top end connected in fluid relationship to the inner inlet of said delivery outlet portion substantially below the surface of the reservoir liquid, said air-trap chamber having a size and configuration sufficient to hold substantially more liquid when primed than the liquid capacity of that portion of the downstream leg that extends below the top of said chamber which condition is effective to maintain a substantial quantity of liquid in said chamber to form an air-lock adjacent such lower downstream leg outlet portion by means of the weight of the liquid alone without other mechanical assistance to maintain the prime in the siphon by preventing the liquid level in said chamber from being sucked below said downstream outlet portion which prevents entry of air at atmospheric pressure into said passage means through said delivery outlet when said upstream leg is submerged in the reservoir liquid and a vacuum is applied to the air aperture opening, whereby, after priming, liquid is transferred from said supply reservoir over the intermediate elevation passage portion by pressure of the atmosphere on the reservoir liquid which forces the liquid up the upstream shorter leg while the excess weight of the liquid in the downstream longer leg once filled, causes continuous flow of liquid downstream through said chamber and out said delivery outlet.

2. The arrangement of claim 1 wherein said inner passage means includes a second air aperture passage and an intermediate supply chamber, positioned between the short leg and the intermediate elevation level thereof, said intermediate chamber having its lower end connected in fluid relationship with the intermediate level, its upper end connected to the upper end of the short leg and to the lower end of said second air aperture passage whereby the intermediate chamber may be filled by liquid from the primary open supply reservoir when a vacuum is applied to the intermediate level air aperture means while the air to the air aperture means is blocked and the delivery outlet is temporarily blocked, which forces liquid up the shorter leg into the intermediate chamber over the intermediate level into the air-trap chamber and out the delivery outlet in continuous flow.

3. The arrangement of claim 2 including means associated with the intermediate level air aperture for selectively interrupting the flow of liquid.

4. The invention of claim 3 wherein the liquid in said intermediate chamber is operable to be transferred continuously from said intermediate chamber over the intermediate level by application of a vacuum to the intermediate level aperture while the aperture to the intermediate chamber is closed, said flow continuing until such intermediate chamber is emptied, independently of the supply reservoir.

5. The invention of claim 2 including means associated with the intermediate level gas aperture and intermediate chamber gas aperture for selectively shifting the vacuum with respect to the intermediate level and the intermediate chamber for automaticaly interrupting the flow and automatically filling and emptying the intermediate chamber.

6. The invention of claim 2 wherein the downstream long leg passage is made substantially larger in diameter and cross section than the diameter and cross section of the intermediate level passage and sloped downwardly starting with the intersection of the downstream leg with the air aperture passage and intermediate level passage a substantial distance to a point above the downstream leg outlet where it is reduced to a lesser sized diameter and cross section comparable with the diameter and cross section of the intermediate level passage before reaching said downstream leg outlet, the diameter and cross section of said substantially enlarged portion of said downstream leg is increased sufficiently over the diameter and cross section of said intermediate passage to allow gases to travel freely upwardly along the enlarged passage portion to degas the liquid while the lesser diameter liquid flow determined by the lesser diameter and cross section of said intermediate passage is flowing down said enlarged passage portion.

7. The invention of claim 1 wherein the long leg passage is made substantially larger in diameter than the diameter of the intermediate level passage downwardly for a substantial portion of its length starting with the intersection of the downstream long leg with the air aperture passage and intermediate level passage and extending downwardly a substantial distance to a point above the downstream leg outlet where it is reduced to a lesser size diameter, comparable with the diameter of said intermediate level passage, before reaching said downstream outlet portion, the diameter of said substantially larger portion of said downstream leg is increased sufficiently over the diameter of said intermediate passage to allow gases to travel freely upwardly along the enlarged passage portion to degas the liquid while the lesser diameter liquid flow determined by the lesser diameter of said intermediate level passage is flowing down said enlarged passage portion.

8. The invention of claim 1 including a flat plate member placed over the delivery outlet to temporarily block and seal and seal the delivery outlet to prevent air from entering the passage means while a vacuum is applied to the air aperture means and the short siphon leg is substantially submerged in the supply reservoir liquid.

9. The invention as set forth in claim 1, wherein the head relationship between the primary reservoir, the air aperture and the air trap chamber is arranged and adapted to facilitate continuous flow of liquid from the reservoir through the passages to the chamber by application of low grade negative pressure to the air aperture.

10. In a siphon-like device for intermittent delivery of high temperature liquids on demand from a supply reservoir containing such liquid at a predetermined level to a second container located at an elevation below said given level, said device comprising internal passage means arranged substantially in the outline of a siphon including walls defining an upstream passage leg having an inlet portion adapted to be submerged in the reservoir liquid below the surface thereof, walls defining a downstream passage leg sloped forwardly at a substantial angle with the horizontal and disposed outside of the reservoir, walls defining a fluid delivery outlet portion having an outlet and an inlet located substantially below said reservoir liquid level communicating with said downstream leg, said legs being joined together in fluid relationship at their upper extremities to form an intermediate elevation fluid passage above the critical liquid level, the improvement wherein:

said downstream long leg passage is made substantially larger in diameter and cross section than the diameter and cross section of the intermediate level passage for a substantial portion of its length starting with the intersection of the downstream leg with the intermediate level passsage and sloping downwardly a substantial distance to a point above the downstream leg outlet where it is reduced to a lesser sized diameter comparable with the diameter and cross section of the intermediate level passage before reaching said downstream leg outlet portion, the diameter and cross section of said substantially larger portion of said downstream leg is increased sufficiently over the diameter of said intermediate passage to allow gases to travel freely upwardly along the enlarged passage portion to degas the liquid while the lesser diameter liquid flow determined by the lesser diameter of said intermediate level passage is flowing down said enlarged passage portion, and air aperture means having upwardly depending walls defining an air passage connected in fluid relationship to said larger downstream leg portion and said intermediate level portion adjacent the intersection of said larger portion with said intermediate passage operable to apply negative pressure to said degassing portion sufficient to simultaneously create a siphon condition and degassing condition in said downstream leg.

* * * * *